US005149081A

United States Patent [19]

Greive

[11] Patent Number: 5,149,081

[45] Date of Patent: Sep. 22, 1992

[54] FEED TABLE UNIT OF A SHEET-FED PRINTING MACHINE

[75] Inventor: Martin Greive, Heidelberg-Ziegelhausen, Fed. Rep. of Germany

[73] Assignee: Heidelberger Druckmaschinen AG, Heidelberg, Fed. Rep. of Germany

[21] Appl. No.: 655,160

[22] Filed: Feb. 13, 1991

[51] Int. Cl.[5] ..... B65H 5/02

[52] U.S. Cl. ..... 271/272; 271/200; 271/198; 271/275; 198/586; 198/861.1

[58] Field of Search ..... 271/198, 200, 275, 272; 198/586, 861.1

[56] References Cited

U.S. PATENT DOCUMENTS

| | | | |
|---|---|---|---|
| 3,860,232 | 1/1975 | Martin | 271/198 |
| 3,975,013 | 8/1976 | Deisting | 271/275 |
| 4,958,823 | 9/1990 | Iwaki et al. | 271/164 |

FOREIGN PATENT DOCUMENTS

| | | | |
|---|---|---|---|
| 646002 | 5/1937 | Fed. Rep. of Germany . | |
| 1028588 | 4/1958 | Fed. Rep. of Germany | 271/10 |
| 2423248 | 11/1975 | Fed. Rep. of Germany | 271/275 |
| 0138183 | 10/1979 | Fed. Rep. of Germany | 271/200 |
| 1033404 | 6/1966 | United Kingdom | 271/198 |

*Primary Examiner*—H. Grant Skaggs
*Assistant Examiner*—Carol L. Druzbick
*Attorney, Agent, or Firm*—Herbert L. Lerner; Laurence A. Greenberg

[57] ABSTRACT

A feed table unit of a sheet-fed printing machine with machine side frames for feeding sheets of paper from a stacker to a printing unit includes a feed table including a table top, two side parts holding the table top, a conveyor having a drive for revolving the conveyor about the table top, and deflection rollers supported in the side parts for guiding the conveyor, the feed table being supported so as to be laterally displaceable with respect to the machine side frames from an operating position to a rest position, the feed table being laterally lockable into the operating position thereof, the printing unit having a drive connected with the deflection rollers in the operating position of the feed table.

8 Claims, 12 Drawing Sheets 1
5
17
24
10
23
27
9
6
15
4

5b 7
4
66
46
13
19
48
49
50
44
45
47
5b

FEED TABLE UNIT OF A SHEET-FED PRINTING MACHINE

The invention relates to a feed table unit of a sheet-fed printing machine with machine side frames, over which paper sheets are fed from a stacker to a printing unit, including a feed table formed of a table top held by two side parts, and revolving conveyors provided with a drive and being guided by deflection rollers supported in the side parts.

German Patent 646 002 illustrates a feed table unit of a sheet-fed printing machine with machine side frames, over which paper sheets are fed from a stacker to a printing unit, including a feed table formed of a table top held by two side parts, and also revolving conveyors provided with a drive and guided by deflection rollers supported in the side parts. Thus, this German patent exemplifies the state of the art.

Feed tables of the foregoing general type have been provided with an upwardly pivotable capability in the interest of affording accessibility to machine parts located in the printing unit. In these heretoforeknown constructions, satisfactory accessibility is attained only by dispensing, as far as possible, with the use of the space above the feed table, which has to be kept free for the pivoting operation, especially on the side of the feed table facing towards the printing unit.

A feed table of this generally known type therefore represents an unsatisfactory compromise between wasted design or construction space, which is required for example when using a satellite printing unit, and reasonably satisfactory accessibility to parts located in the printing unit.

Moreover, the neutral-phase operativeness of parts located on the feed table and driven in accordance with the machine cycle, such as the front guides or lays provided on the feed table, cannot be maintained whenever parts located in the printing unit have to be accessed, so that it has to be restored afterwards.

Additionally the operator must expand a certain amount of effort in order to tilt or pivot such a table manually upwards.

A feed table of this type, even in a tilted or upwardly pivoted position, restricts the space in front of the printing unit which is needed for access to parts located in the printing unit, if only because the table completely remains in this space. In the construction of such a table, an increased risk of injury to operating personnel must be taken into consideration.

In the case of feed tables with a tilting or pivoting capability, the use of parts located thereon and moved in accordance with the machine cycle, such as the front lays or guides, presents a further problem. If the drive for these parts is effected from the printing-unit side, problems of attachment and exact rhythmical movement will occur. If the drive is produced from the other side, additional driving gears are required It is accordingly, an object of the invention to provide a feed table unit which can be removed, in a relatively simple manner from its working or operating position, so that accessibility is improved and so that the working or operating position of parts located on the feed table and moved in accordance with the machine cycle remains in neutral phase when this feed table position is restored.

With the foregoing and other objects in view, there is provided, in accordance with the invention, a feed table unit of a sheet-fed printing machine with machine side frames for feeding sheets of paper from a stacker to a printing unit, comprising a feed table including a table top, two side parts holding the table top, conveyor means having a drive for revolving the conveyor means about the table top, and deflection rollers supported in the side parts for guiding the conveyor means, the feed table being supported so as to be laterally displaceable with respect to the machine side frames from an operating position to a rest position, the fee table being laterally lockable into the operating position thereof, the printing unit having a drive connected with the deflection rollers in the operating position of the feed table.

The feed table unit according to the invention ensures maximum accessibility to parts located in the printing unit. The space above the feed table is not unnecessarily restricted by any required tilting or pivoting movements of the table. When the feed table is shifted, virtually the entire space occupied by the feed table in its working or operating position is available for use to access the parts located in the printing unit. If the feed table is pushed back to the working or operating position, front lays or guides or other parts on the feed table which are driven in accordance with the machine cycle are immediately returned to their neutral phase working or operating position. The use of such a feed table also permits the overlying and underlying space to be taken into account for design or construction purposes, as appears desirable, for example, in the use of satellite printing units or duplexing printing units.

In accordance with another feature of the invention, there is provided a shaft fastened at one side of the feed table in the machine side frames, a holding element provided at a side of the feed table opposite the one side thereof in the machine side frames, and the feed table being supported on the shaft and on the holding element so as to be displaceable with respect to the machine side frames.

Such a feed table is already manually displaceable. In the case of small printing machines, in particular, no additional adjusting element is required, which makes this table economically as well as ergonomically advantageous.

In accordance with a further feature of the invention, the shaft is fixed in the machine side frames at a side of the feed table facing towards the printing unit, the shaft having a length substantially twice the width of the feed table, the feed table being displaceably mounted on the shaft on at least two bearing locations, and on the holding element on one bearing location. This will especially stabilize the moved machine parts provided on the side of the feed table facing towards the printing unit, such as front lays or guides, and will therefore favor the maintenance of their neutral-phase working or operating position and an especially smooth and precise paper run or travel in the vicinity of the printing unit. Moreover, this mounting or support arrangement can be produced relatively simply and economically. Space utilization and, therefore, accessibility to machine parts located in the printing unit can be optimized by constructing the equipment so that the length of the shaft is nearly twice the breadth or width of the feed table, which permits the feed table to be removable almost completely from the space which it occupies in the working or operating position thereof.

In accordance with an added feature of the invention, there are provided spindle bearing locations formed on the machine side frames, a rotatable spindle firmly supported axially in the spindle bearing locations, and a spindle casing disposed around the spindle and fastened to one of the side parts of the feed table.

This provides an inexpensive configuration of the lateral adjustability, which is additionally relatively simple and precise to handle. By turning the spindle, for example, manually by means of a handwheel or electrically, pneumatically or hydraulically by means of appropriate separate controlling mechanisms, the feed table can be adjusted with respect to the lateral position thereof.

In accordance with an additional feature of the invention, there are provided a lever fastened to the feed table, and a grooved bushing mounted on the shaft, the lever and the grooved bushing being in cooperative engagement for locking the feed table in the operating position thereof.

A low-cost, relatively simple and secure positioning construction with the aid of which the feed table unit can be locked in its working or operating position is thereby provided, thus preventing the feed table unit from being inadvertently shifted, for example, during the paper run of the machine.

A particularly simple, low-cost drive connection of the deflection rollers with the printing unit drive, which requires only a few driving parts, and by which the neutralphase working or operating position of the driven machine parts on the feed table is not interrupted when the table is moved, is afforded in accordance with yet another feature of the invention wherein there are provided mutually meshing gears respectively seated on a drive shaft and on a driven shaft and being fixed against relative rotation with the respective shafts, the gear on the drive shaft being fastened thereto so as to be axially displaceable, the gear seated on the driven shaft being fixed against axial displacement, and including a device for axially guiding the axially displaceable gear.

In accordance with yet a further feature of the invention, the drive shaft is journaled in the machine side frames, and the driven shaft is journaled in the side parts facing towards the printing unit.

In accordance with a concomitant feature of the invention, there are provided two plates of substantially like dimensions screwed with spacer bushings therebetween to a side frame of the feed table so that the distance therebetween is slightly greater than the width of a tooth of the displaceable gear, the plates being formed with a concentric bore through which the drive shaft freely rotatably extends, the displaceable gear being positioned on the drive shaft so that it is rotatable together with the drive shaft between the two plates, thrust bearings are provided between the plates, respectively, and the gear, and an adjusting key connection are provided between the drive shaft and the gear for entraining the gear for movement axially when the feed table is displaced.

The foregoing last two constructions represent preferred versions of the drive connection by means of gears, axial guidance, and displaceability of a gear fastened so as to be axially displaceable.

Other features which are considered as characteristic for the invention are set forth in the appended claims.

Although the invention is illustrated and described herein as embodied in a feed table unit of a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1*a* and 1*b* are respective downstream and upstream side elevational views of a feed table constructed in accordance with the invention;

FIGS. 2*a* and 2*b* are respective downstream and upstream top plan views of FIGS. 1*a* and 1*b;*

Figure 4:
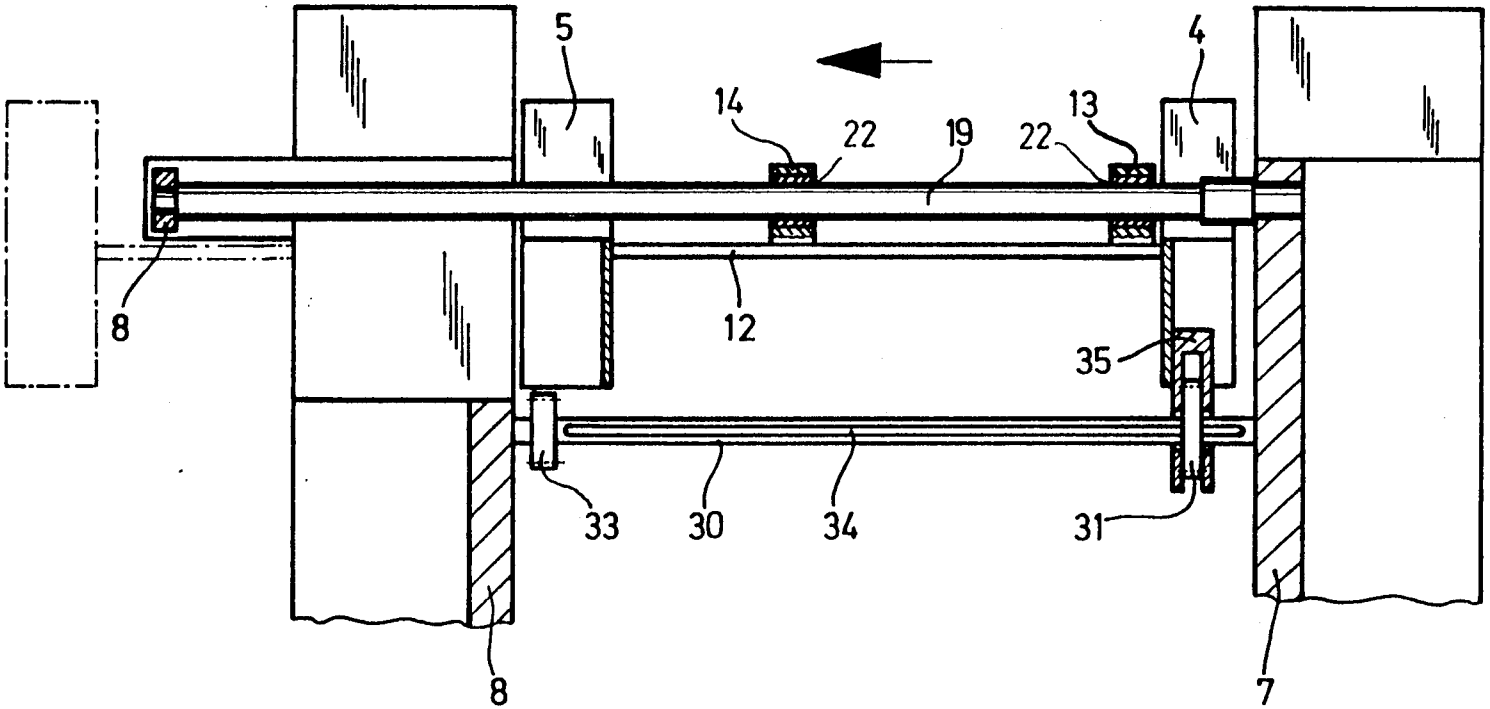
FIG. 4 is a cross-sectional view of FIG. 1*a* taken along the line 4—4 in the direction of the arrows and showing a shifting mechanism of the feed table.
Figure 5A:
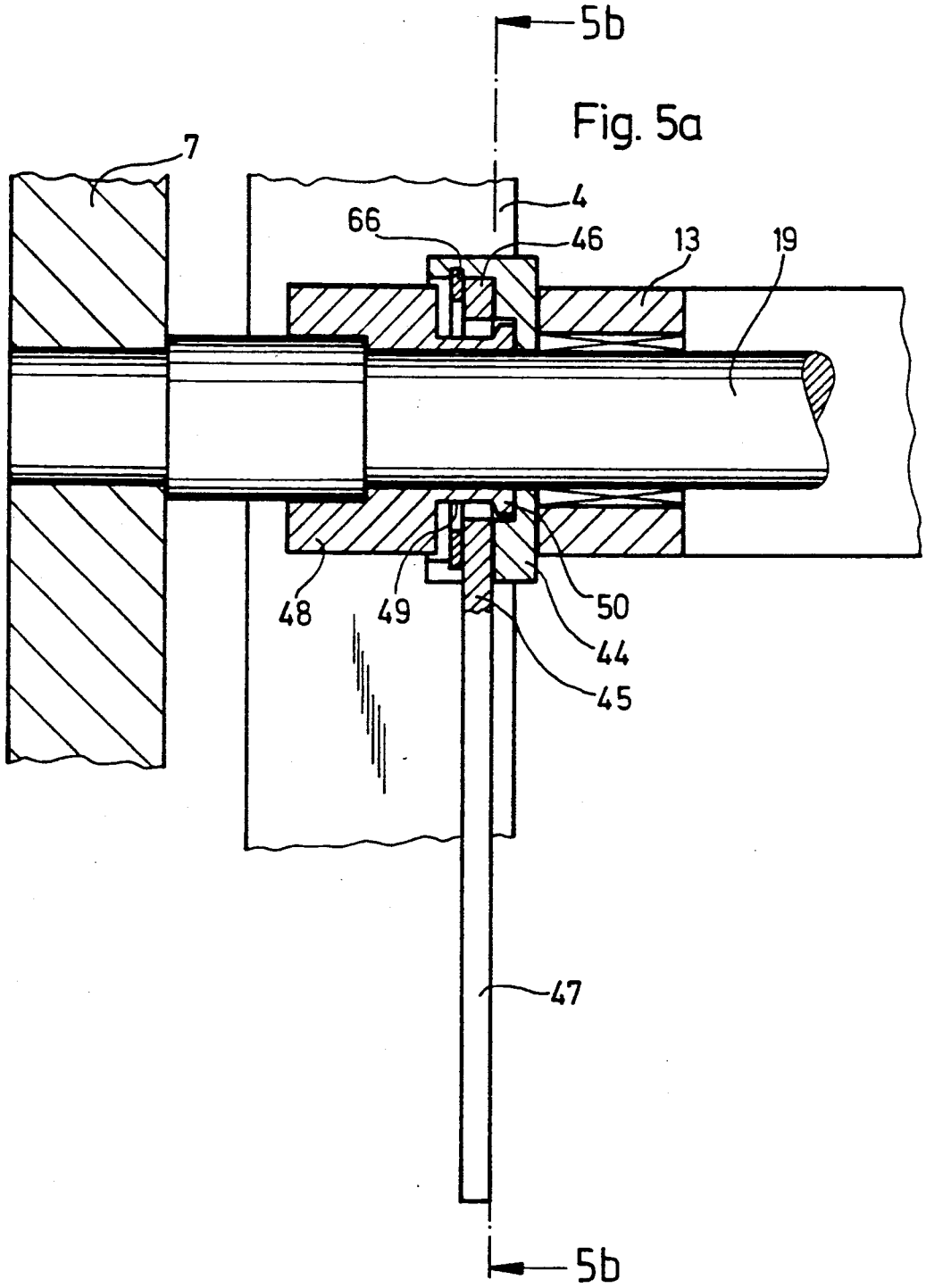
Figure 5B:
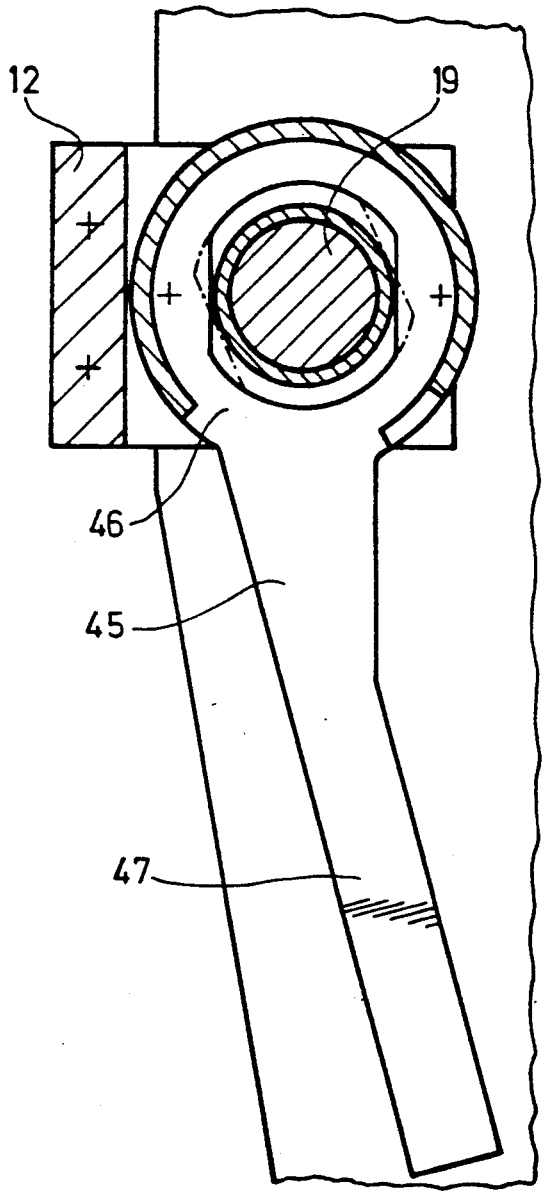
Figure 6:
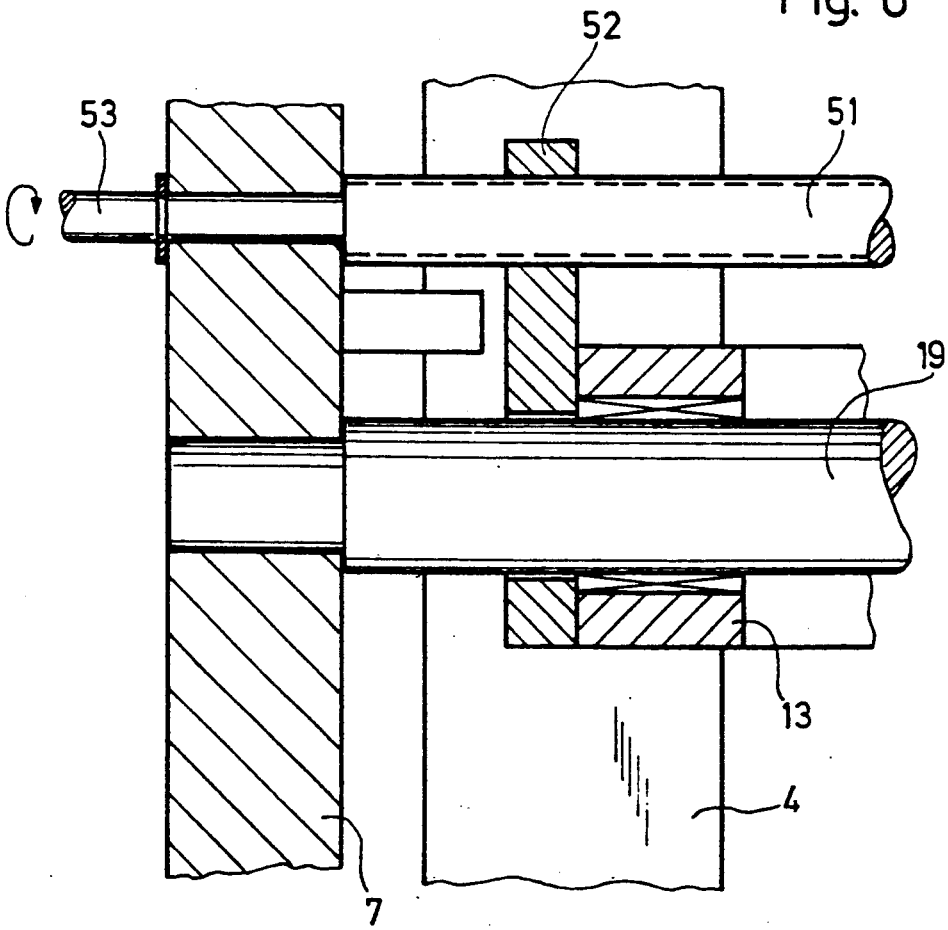
Figure 7:
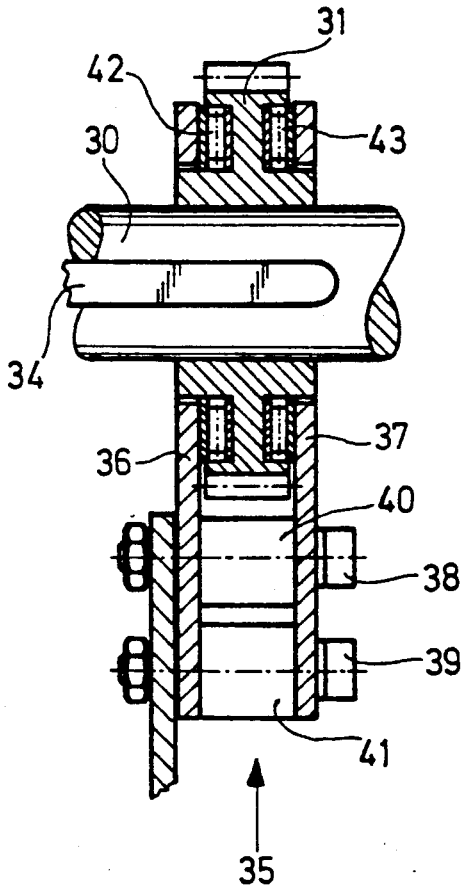
Figure 8A:
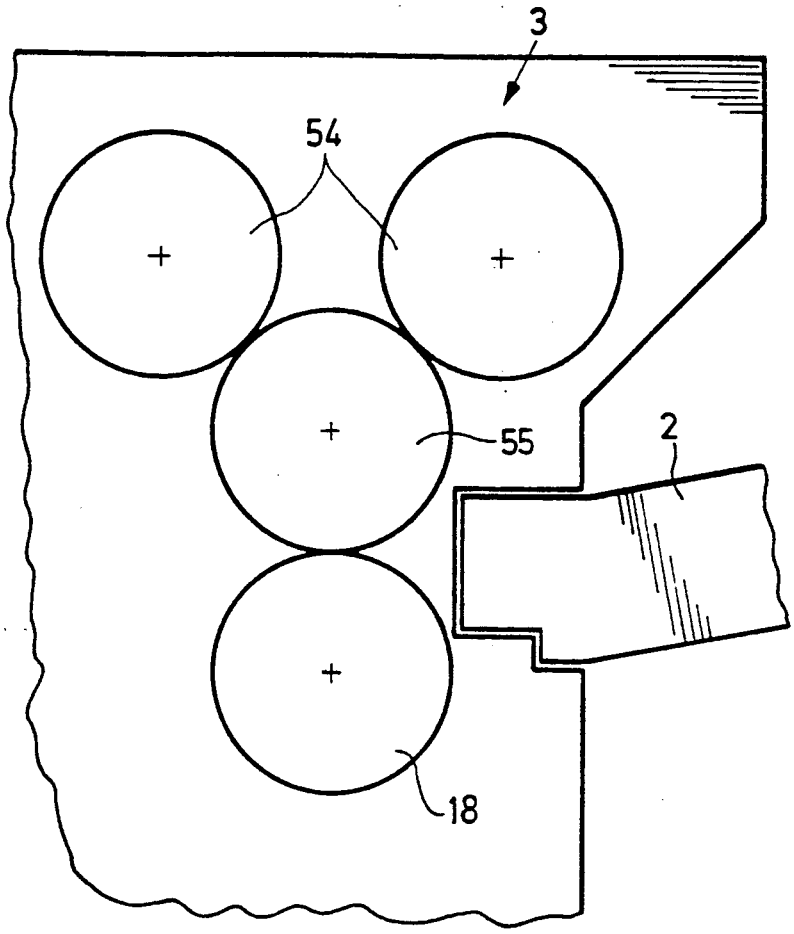
Figure 8B:
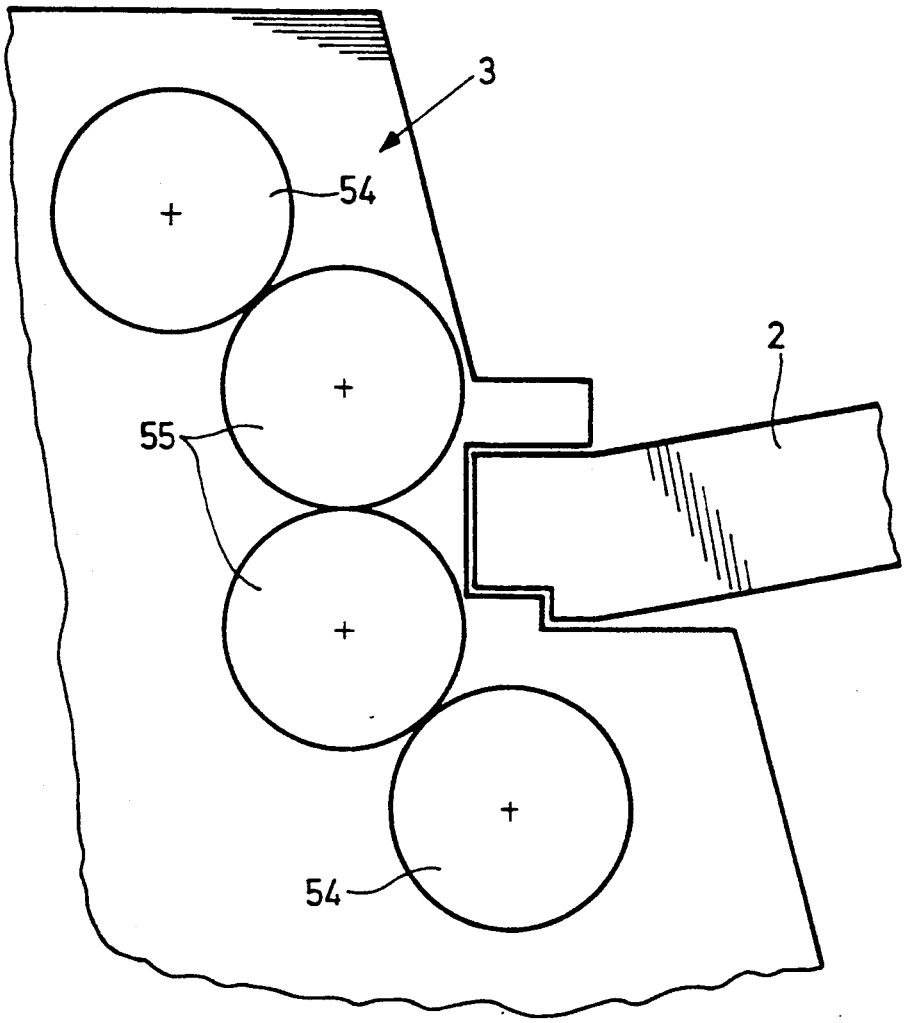

FIG. 5*a* is an enlarged fragmentary view of FIG. 4 as seen from behind the plane of the drawing of FIG. 4, and showing a stopping or positioning device on a shaft;

FIG. 5*b* is a cross-sectional view of FIG. 5*a* taken along the line 5*b*–5*b* in the direction of the arrows;

FIG. 6 is a view like that of FIG. 5*a* of an alternate embodiment of an adjusting device for the feed table which includes a spindle;

FIG. 7 is an enlarged fragmentary view of FIG. 4, showing an entrainer fork for axially shifting a toothed gear in accordance with the invention; and FIGS. 8*a* and 8*b* are diagrammatic side elevational views of printing unit arrangements for which a displaceable feed table according to the invention is especially suitable, namely a satellite printing unit and a duplexing printing unit, respectively.

Referring now to the drawings and, first, particularly to FIGS. 1*a* and 1*b* and 2*a* and 2*b* thereof, there is shown thereon in sectional views, a sheet-fed printing machine with a feed table 2 via which sheets of paper 21 are fed by means of conveyor belts 20 from a sheet stacker 1 to a printing unit 3. Machine side frames 7, 8, 9, 10 represent the supporting external walls of the sheet-fed printing machine.

The feed table 2, which is formed of two side parts 4 and 5 and a table top 6 supported thereby, is provided, on the side thereof facing towards the printing unit, with a transverse cross arm or traverse 12, which is mounted in an upper region of the side parts 4 and 5 and is attached thereto therebetween, this transverse cross arm 12 being provided with two upwardly directed holding elements 13 and 14. The latter are respectively provided, above the side parts 4 and 5, with a concentric bore hole 22 aligned parallel to the table top 6 transversely to the conveying direction. At a lower region of a side 17 of the feed table 2 facing towards the sheet stacker 1 there is also a transverse cross arm or traverse 15 located between and fastened to the side parts 4 and 5.

A shaft 19 is mounted so as to be axially displaceable in the bore holes 22 formed in the holding elements 13 and 14, between the machine side frames 7 and 8 in a region of the printing unit slightly above the sheet feeding location on the side facing towards the feed table 2, and aligned perpendicularly to the sheet-conveying direction and parallel to a plane in which the sheets are conveyed.

On the sheet stacker 1, and on a traverse or cross arm 23 thereof firmly fixed between the machine side frames 9 and 10, a holding element 24 has been provided below the feed table 2 and supports the transverse cross arm 15 of the feed table 2 on a contact location 25 thereof, so that the cross arm 15 is horizontally displaceable thereon.

A maximum spacing or distance from the location at which the shaft 19 is fastened in the frame 8 on the right-hand side of the machine to the holding element 14 nearly corresponds to the width or breadth of the feed table 2. The contact location 25 is halfway along the length of the shaft 19. Thus, the feed table 2 can be shifted by nearly the whole width or breadth thereof.

Conveyor belts 20 pass around the table top 6 via deflection rollers 26 and 27 mounted in the side parts 4 and 5.

Figure 3:
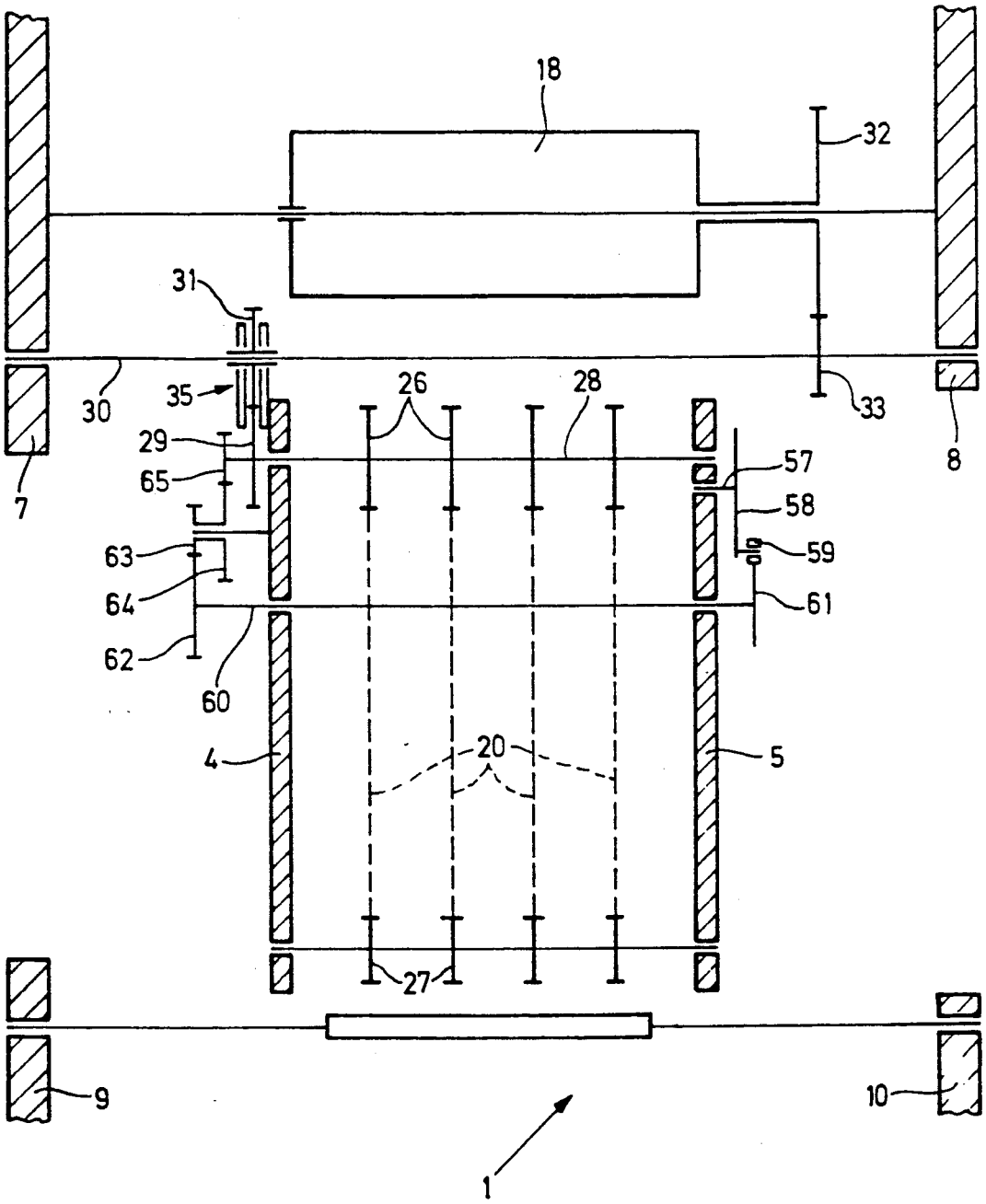
FIG. 3 is a schematic top plan view of the drive of the feed table of FIGS. 1*a* and 1*b;*

The rotational axis of the deflection rollers 26 is coincident with that of a driven shaft 28 having a gear 29 fastened thereon, via which, as can be seen in the drive diagram of FIG. 3, the driving torque of a drive shaft 30 mounted in the machine side frames 7 and 8 below the feed table 2 is transmitted, with the aid of a gear 31, to the driven shaft 28 and thus to the deflection rollers 26. The drive shaft 30, for its part, is driven by an impression cylinder 18, which is mounted in the machine side frames 7 and 8, via a gear configuration formed, for example, of gears 32 and 33, so that the driven shaft 28 rotates in the direction of the impression cylinder 18.

Figure 1A:
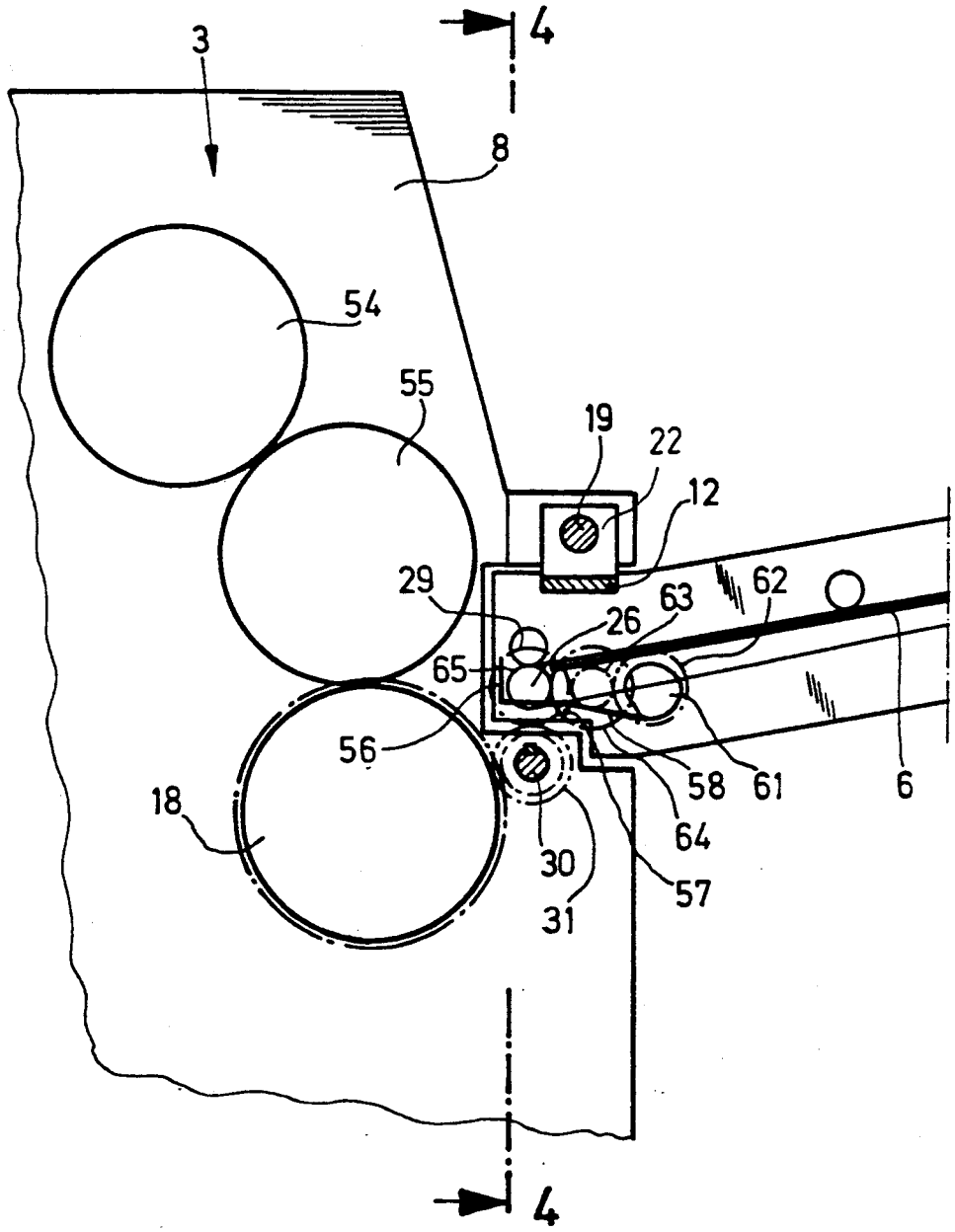
Figure 1B:
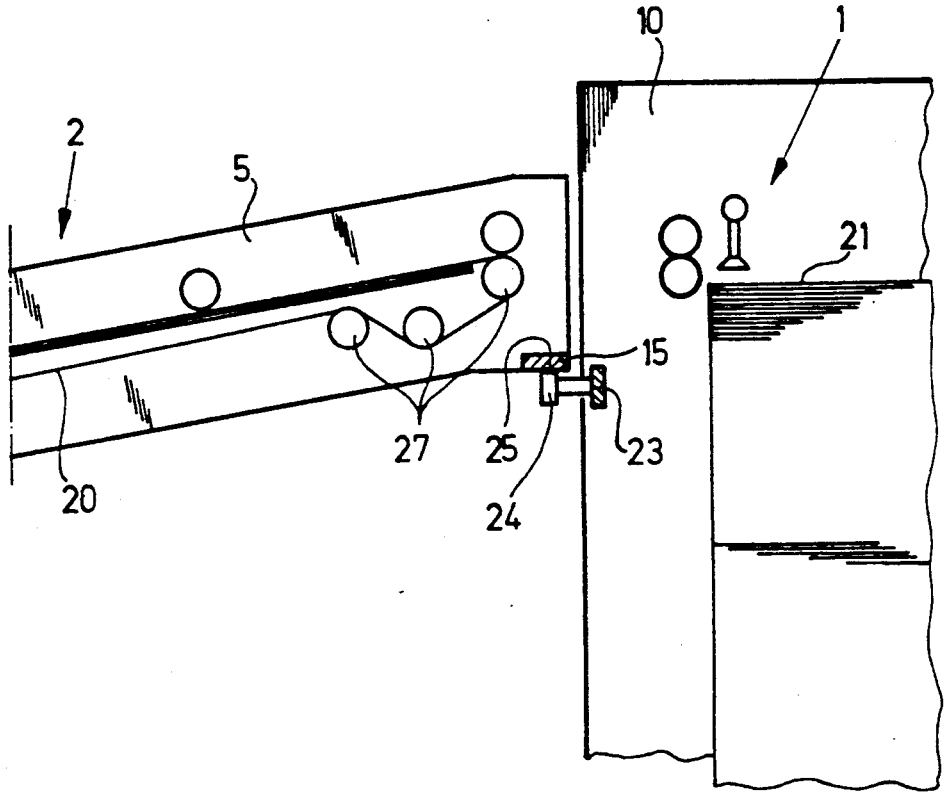

As can be seen in FIG. 4, which is a sectional view of FIG. 1*a* taken along the line 4—4, wherein, in the interest of clarity, for example, the table top 6, the conveyor belts 20 and the deflection rollers 26 have been omitted, an adjusting key 34 is provided in the drive shaft 30, between the gear 33 and the frame 7 on the left-hand side of the machine, in the sheet-conveying direction, the length of the adjusting key 34 being somewhat greater than the maximum shifting length or distance of the feed table 2.

By means of the adjusting key 34, the gear 31 is axially displaceably mounted on the drive shaft 30 yet fixed against rotation relative thereto, in the operating position of the table 2 near the machine side frame 7. On the left-hand side part 4, as viewed in the sheet-conveying direction of the feed table 2, an entrainer fork 35 is fastened towards the outside and, in the space between the tines of the fork 35, the gear 31 is held in a freely rotatable but axially fixed manner so that it is constantly in meshing engagement with the gear 29.

The entrainer fork 35 is formed, for example as illustrated in FIG. 7, of two plates 36 and 37 of like dimensions which are rigidly fastened to the side part of the feed table 2 by means of two screw connections 38 and 39 and, located between them, two spacer bushings 40 and 41 through which the screws of the screw connections 38 and 39 extend, the length thereof being somewhat greater than the width or breadth of the teeth of the gear 31.

The two plates 36 and 37 are formed with bore holes of identical dimensions through which the shaft 30 passes concentrically and freely rotatably. Between the plates 36 and 37, the gear 31 is rotatably supported by means of two thrust bearings 42 and 43 which are disposed concentrically with the shaft 30.

Instead of a connection with an adjusting key 34, a connection can be used which is formed, for example, of a splined shaft, a polygonal profile shaft or the like.

The feed table 2 can be positioned as shown in the interest of clarity in FIGS. 5*a* and 5*b*, for example. On the side of the positioning device 13 facing the side frame 7 on the left-hand side of the machine, an inner bushing 44 is firmly flanged to the positioning device 13 and is provided with a through-bore through which the shaft 19 passes concentrically and with clearance. A swivel head 46 of a lever 45 provided for positioning is supported in the bore of the bushing 44 so that the swivel head 46 is concentrically rotatable around the shaft 19 and secured against axial displacement by a locking ring 66. Via a recess formed in a section of the circumference of the bushing 44, a lever arm 47 of the lever 45 passes through the bushing 44 and can be turned around the shaft 19 over the angular range provided by the recess.

The lever head 46 is formed with a pass-through opening which is concentric with the shaft 19, as shown in FIG. 5*b*, and has a circumferential profile corresponding to the profile of a larger circle cut by two diametrically opposed tangents to a smaller circle.

At the end of the shaft 19 on the side facing towards the side frame 7 of the machine, there is a firmly fixed outer bushing 48, provided for positioning, which is formed with a circumferential groove 49 having an inner or base diameter corresponding to that of the aforementioned smaller circle and a width somewhat greater than the thickness of the lever head 46 as shown in FIG. 5*a*. This circumferential groove 49 is located near an edge region of the outer bushing 48 facing the feed table 2 so that a narrow circumferential ridge 50 remains between the grooves 49 and the edge.

The circumferential profile of the ridge 50 corresponds to the circumferential profile of the pass-through opening formed in the lever head 46 so that, with the lever 45 pointing upwardly in the opened position, the two profiles are superimposed nd can be shifted over one another with clearance of play. In the region of the groove 49, the lever 45 can be turned until it is stopped, and the profiles of the circular pass-through opening in the lever head 46 and the ridge 50 cross and cause a locking of the ridge 50 and the lever 45.

The circumferential ridge 50 is slightly inclined or beveled towards the base of the circumferential groove 49 in axial direction, as shown in FIG. 5*a*, and the dimensioning at the base of the ridge 50-is so large that, in the axial direction, an interlocking connection is additionally produced and the feed table 2 is thereby firmly positioned.

A feed table of the foregoing construction is displaceable, adjustable and lockable or retainable in position.

Figure 2A:
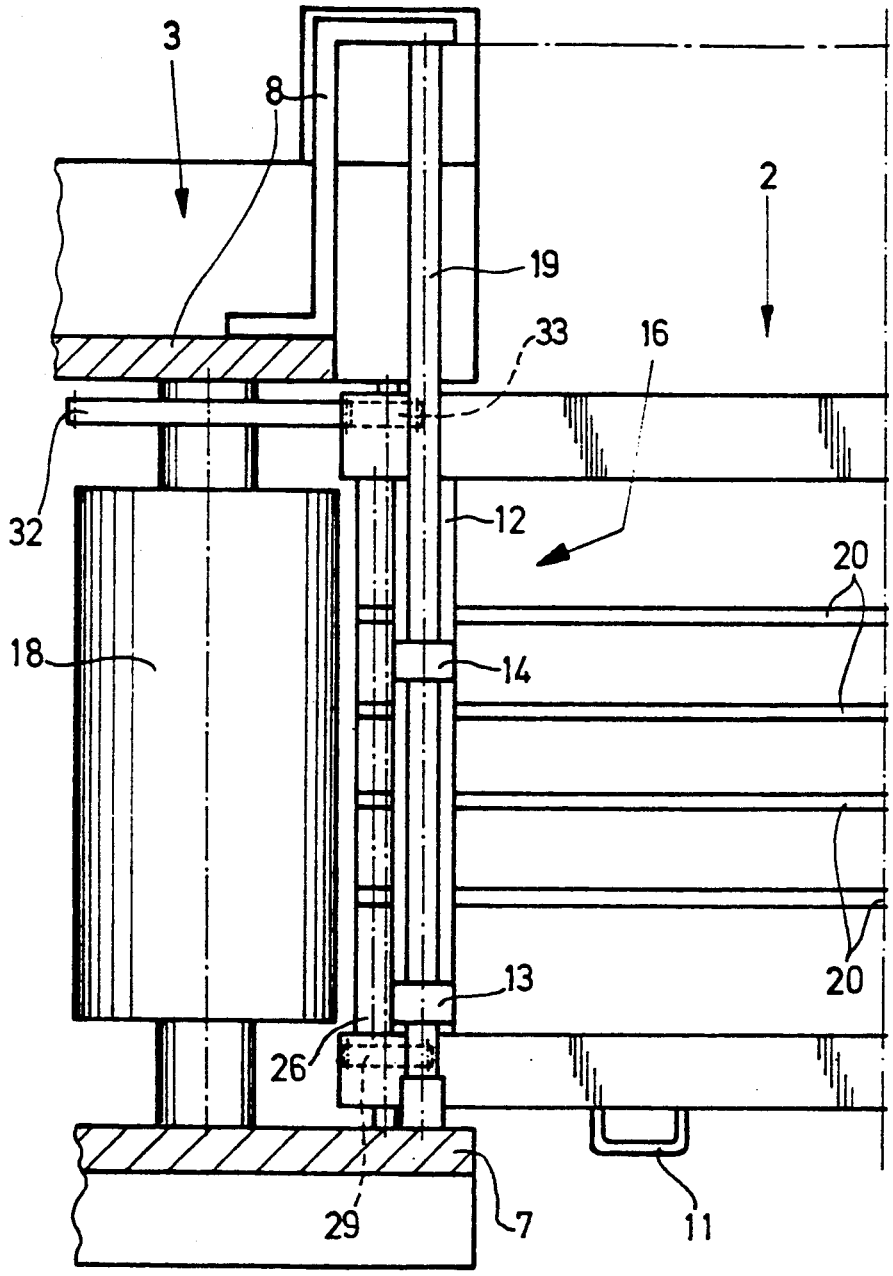
Figure 2B:
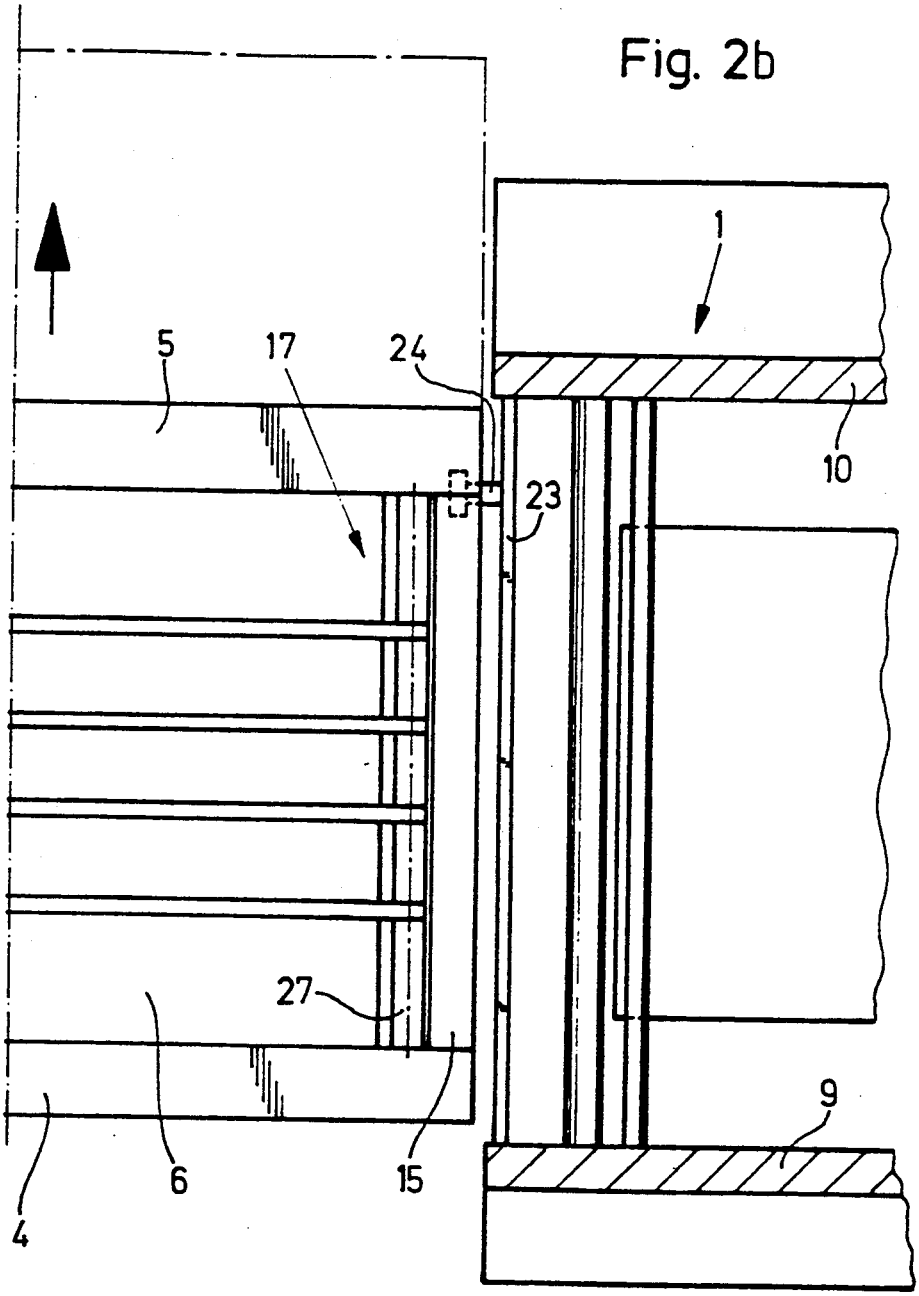

For reasons of safety and greater ease of handling, the feed table 2 is provided with a handle 11 at the outer side of the side part 4 at the left-hand side of the machine in the sheet feeding direction, or at the bottom of FIG. 2*a* of the drawing.

In accordance with FIG. 6, a further construction for adjusting the feed table 2 is represented by a spindle 51 which is rotatably mounted in the machine side frames 7 and 8 parallel to the shaft 19, the spindle 51 having a casing 52 forming an extension of the left-hand side part 4 of the feed table 2. The spindle shaft 51 has an extension 53 projecting outwardly beyond the machine side frame 7. By turning this extension 53, facilitated for example by means of a non-illustrated handwheel, the feed table 2 is shifted with respect to the machine side frames 7 and 8, and the desired position of the feed table 2 is attained.

The outer bushing 48 provided for the positioning can also be fastened to the shaft 19 so that it is displaceable within a range of millimeters and can be positioned precisely by means of a setting or adjusting device such as, for example, a spindle with a self-locking thread supported in the machine side frame 7. This alternate construction permits lateral corrections to be effected when the operating position of the feed table 2 is determined.

In FIG. 1, there are shown diagrammatically front lays or guides 56 moving in accordance with the machine cycle and fastened to a shaft 57 supported in the side parts 4 and 5 of the feed table 2. The shaft 57 has an elongation to the outside at the right-hand side of the side part 5. According to FIG. 3 of the drawings, the shaft 57 is moved via a lever 58 firmly seated thereon, and a roller or runner 59 supported on the lever 58 and engaging, by means of a non-illustrated spring fastened to the side part 4, with a cam plate 61 fastened to a shaft 60. The shaft 60 is journaled in the side parts 4 and 5 and is provided with a gear 62 on an extension thereof passing through the side part 4. The gear 62 is driven by a gear 65 is synchronism with the impression cylinder 18 via gears 63 and 64 supported on a journal fastened to the side part 4.

A conventional 7o'clock printing until arrangement formed of an impression cylinder 18, a plate cylinder 54 and a blanket cylinder 55 supported in side frames of a printing machine is represented in FIG. 1*a*.

FIGS. 8*a* and 8*b* illustrate printing-unit arrangements, wherein the introduction of movable or shiftable feed tables 2 is effected especially advantageously. FIG. 8*a* shows a satellite printing unit 3 with the plate cylinders 54, the blanket cylinder 55 and the impression cylinder 18, and FIG. 8*b* a double impression-cylinder arrangement with the blanket cylinders 55 and the plate cylinders 54.

I claim:

1. Feed table unit of a sheet-fed printing machine with machine side frames for feeding sheets of paper from a stacker to a printing unit, comprising a feed table including a table top, two side parts holding said table top, endless flexible conveyor means having a drive for revolving said conveyor means around said table top, and deflection rollers supported in said side parts for guiding said conveyor means, said feed table being supported so as to be laterally displaceable with respect to the machine side frames from an operating position to a rest position, said fed table being laterally lockable fixedly into said operating position thereof, the printing unit having a drive connected with said deflection rollers in said operating position of said feed table.

2. Feed table unit of a sheet-fed printing machine with machine side frames for feeding sheets of paper from a stacker to a printing unit, comprising a feed table including a table top, two side parts holding said table top, conveyor means having a drive for revolving said conveyor means about said table top, and deflection rollers supported in said side parts for guiding said conveyor means, said feed table being supported sos as to be laterally displaceable with respect to the machine side frames from an operating position to a rest position, said feed table being laterally lockable into said operating position thereof, the printing unit having a drive connected with said deflection rollers in said operating position of said fed table, and including a shaft fastened at one side of said feed table in the machine side frames, holding element provided at a side of said feed table opposite said one side thereof in the machine side frames, and said fed table being supported on said shaft and on said holding element so as to be displaceable with respect to the machine side frames.

3. Feed table unit according to claim 2, wherein said shaft is fixed in the machine side frames at a side of said feed table facing towards the printing unit, said shaft having a length substantially twice the width of said feed table, said feed table being displaceably mounted on said shaft on at least two bearing locations, and on said holding element on one bearing location.

4. Feed table unit according to claim 2, including a lever fastened to said feed table, and a grooved bushing mounted on said shaft, said lever and said grooved bushing being in cooperative engagement for locking said feed table in said operating position thereof.

5. Feed table until of a sheet-fed printing machine with machine side frames for feeding sheets of paper from a stacker to a printing unit, comprising a feed table including a table top, two side parts holding said table top, conveyor means having a drive for revolving said conveyor means about said table top, and deflection rollers supported in said side parts for guiding said conveyor means, said feed table being supported so as to be laterally displaceable with respect to the machine side frames from an operating position into a rest position, said feed table being laterally lockable into said operating position thereof, the printing unit having a drive connected with said deflection rollers in said operating position of said feed table, and including spindle bearing locations formed on the machine side frames, a rotatable spindle firmly supported axially in said spindle bearing locations, and a spindle casing disposed around said spindle and fastened to one of the side parts of said feed table.

6. Feed table unit of a sheet-fed printing machine with machine side frames for feeding sheets of paper from a stacker to a printing unit, comprising a feed table including a table top, two side parts holding said table top, conveyor means having a drive for revolving said conveyor means about said table top, and deflection rollers supported in said side parts for guiding said conveyor means, said feed table being supported so as to be laterally displaceable with respect to the machine side frames from an operating position to a rest position, said feed table being laterally lockable into said operating position thereof, the printing unit having a drive connected with said deflection rollers in said operating position of said feed table, and including mutually meshing gears respectively seated on a drive shaft and on a driven shaft and being fixed against relative rotation with the respective shafts, said gear on said drive shaft being fastened thereto so as to be axially displaceable, said gear seated on said driven shaft being fixed against axial displacement, and a device for axially guiding said axially displaceable gear.

7. Feed tale unit according to claim 6, wherein said drive shaft is journaled in the machine side frames, and said driver shaft is journaled in said side parts facing towards the printing unit.

8. Feed table unit according to claim 7, wherein said device for axially guiding said axially displaceable gear includes two plates of substantially like dimensions screwed with spacer bushings therebetween to one of said side parts of said feed table so that the distance therebetween is slightly greater than the width of a tooth of said displaceable gear, said plates being formed with a concentric bore through which said drive shaft freely rotatably extends, said displaceable gear being positioned on said drive shaft so that tit is rotatable together with said drive shaft between said two plates, thrust bearings provided between said plates, respectively, and said gear, and an adjusting key connection between said drive shaft and said gear for entraining said gear for movement axially when said feed table is displaced.

* * * * *